United States Patent [19]

Camp et al.

[11] 4,094,398

[45] June 13, 1978

[54] COMPOSITE VENDING CIRCUIT DISPOSABLE IN SINGLE- AND MULTIPLE-PRICED CONFIGURATIONS

[75] Inventors: Vernon D. Camp, Chattanooga, Tenn.; Raymond D. Bowman, Fort Oglethorpe, Ga.

[73] Assignee: Cavalier Corporation, Chattanooga, Tenn.

[21] Appl. No.: 590,855

[22] Filed: Jun. 27, 1975

[51] Int. Cl.[2] ..... G07F 11/00

[52] U.S. Cl. ..... 194/10; 194/1 M

[58] Field of Search ..... 194/1 N, 1 M, 1 L, 2, 194/9 R, 10, DIG. 1, DIG. 3; 221/129

[56] References Cited

U.S. PATENT DOCUMENTS

| | | | |
|---|---|---|---|
| 2,895,582 | 7/1959 | Turner | 221/129 X |
| 3,242,929 | 3/1966 | Adams | 194/1 N |
| 3,486,601 | 12/1969 | Bowman | 194/10 |
| 3,548,991 | 12/1970 | Flubacker | 194/10 |

*Primary Examiner*—Allen N. Knowles
*Assistant Examiner*—Joseph J. Rolla
*Attorney, Agent, or Firm*—Cameron, Kerkam, Sutton, Stowell & Stowell

[57] ABSTRACT

A composite vending control circuit is disclosed that is readily disposable in either a single-priced or multi-priced configuration. The composite vending circuit includes the circuit elements and interconnecting conductors required for operation in either a single- or multi-priced mode of operation. Further, a switching arrangement in the form of interconnectable plugs permit reconnection of the circuit elements whereby the single-priced circuit configuration may be readily adapted to operate in a multi-priced configuration. Thus, conversion may be readily achieved without extensive rewiring or the addition of further circuit elements.

13 Claims, 3 Drawing Figures

COMPOSITE VENDING CIRCUIT DISPOSABLE IN SINGLE- AND MULTIPLE-PRICED CONFIGURATIONS

BACKGROUND OF THE INVENTION

1. Field of the Invention

This invention relates generally to coin-operated vending machines for selectively dispensing articles one-at-a-time from a plurality of sources, and more particularly to an improved composite vending circuit operative in a first configuration to dispense articles of a single price and readily adapted to be operated in a multi-priced configuration, wherein a plurality of articles may be vended at different prices.

2. Description of the Prior Art

Coin-operated vending machines for selectively dispensing articles, one-at-a-time, from a plurality of sources are well known. Such vending machines generally comprise a plurality of stacks of articles which may be vertically arranged in columns in side-by-side relationship. Upon deposit of a suitable coin, credit is established and a dispensing cycle is initiated according to the selection of the customer which causes a vend motor to be cycled and a single article to be dispensed from the selected stack. Such a vending machine is disclosed in U.S. Pat. No. 3,486,601 wherein there is disclosed a plurality of vend motors, each selectively operated by a corresponding selector switch. Though the customer may select one of a plurality of articles to be vended by actuating the corresponding selector switch, the disclosed vending circuit is capable only of delivering articles at a single price.

Because of the variety of products available for sale from vending machines, there is a great demand for vending machines that permit operation at multiple prices. A vending machine that can vend multiple-priced articles has a distinct advantage over vending machines limited to vending single-priced articles, because of being able to satisfy the individual tastes of various customers by being able to accommodate a variety of different-priced articles.

A vending system for vending at different prices should provide for the payout of change where the total value of coins deposited exceeds the unit price of the selection. Known systems of this type generally require a relatively complex and expensive totalizing unit, usually incorporating printed circuit boards or rotating drums and associated wiper elements. The control circuits associated with such units are also relatively complex and expensive and are subject to a variety of malfunctions. An example of multiple-priced vending machine incorporating a totalizer having a printed circuit board and associated wiper elements is illustrated in U.S. Pat. No. 3,335,838.

Where vending machines are installed outdoors, such as at swimming pool site locations, loading ramps, etc., it is desirable to avoid the use of wiper elements and printed circuit boards and minimize the amount of exposed contacts, because exposure to climatic changes may result in frequent and undesirable malfunctions due to dust accumulation and moisture absorption, particularly in areas of high humidity or dampness.

In recent years, continuous increases in the cost of living and the consequent erosion of the value of the dollar have resulted in frequent changes in the cost of canned and bottled beverages. As a result, there has been established the need for a coin changer for vending machines which can be readily modified to accommodate a change in price with a minimum of effort. Further, it should be apparent that there exists throughout the industry a vast quantity of vending equipment having outdated coin changing equipment incapable of multi-priced vending. It was recognized in U.S. Pat. No. 3,550,742 that the cost of updating equipment could be held to a minimum if existing coin changers in widespread use could be modified to permit operation at either 15¢or at 20¢vend price and convertible priced coin changer was proposed. However, the conversion effected in accordance with U.S. Pat. No. 3,550,742 merely provides for one price selection of a single time at one of two preset unit prices. Such a convertible price coin changer is not adapted for dispensing of multiple-priced items from a multiplicity of stacks. Further, the conversion disclosed in U.S. Pat. No. 3,550,742 involves the addition of elements including a totalizer, a pay-out relay, and ganged-priced-setting switches, accompanied by appropriate wiring changes and modification of various cams and switches.

In U.S. Pat. No. 3,776,339, there is described a multi-priced vend control circuit for vending at least two articles at distinct prices. Briefly, there is provided a plurality of vending motors divided into two groups according to the different prices of the articles to be vended. Associated with each vend motor is a corresponding selector switch and selector relay. The selector switches and the selector relays are likewise divided into corresponding groups according to the different priced articles. A coin mechanism is suggested including relays that are actuated upon the deposit of the correct value of money. In particular, upon deposit of a given value of coins, a first or low-priced relay is actuated, whereby the corresponding group of selector switches and selector relays of the corresponding first price or value are enabled to energize a vend motor whereby an article of that price is dispensed. In a similar manner, a second or higher-priced relay is actuated upon deposit of a greater value of coins, whereby the second or higher-priced group of selector switches and selector relays are permitted to be actuated to vend an article of that price. Though it is suggested in U.S. Pat. No. 3,776,339 that existing single-priced vending circuits such as that described in U.S. Pat. No. 3,486,601 may be modified to operate in a multi- or dual-priced mode of operation, it is evident that the proposed modifications would take the form of rewiring the existing single-priced vending circuit into the circuit configuration of U.S. Pat. No. 3,776,339, as well as the addition of the suggested coin changer.

SUMMARY OF THE INVENTION

It is therefore the primary object of the present invention to provide a composite circuit that is readily adapted with a minimum of time and effort from a single-priced configuration to a multi-priced configuration.

Another important object of the present invention is to permit a ready conversion of a single-priced circuit configuration to a multi-priced circuit configuration by simply reconnecting a limited number of conductors through the use of plug assemblies.

Still another important object of the present invention is to provide a composite circuit readily adapted for conversion from a single-priced vending configuration to a multi-priced vending configuration, wherein substantially all of the circuit elements of the composite circuit are employed in both the single- and multi-priced circuit configurations, thus reducing the cost and complexity of the composite circuit.

In accordance with these and other objects, there is disclosed a composite article-vending circuit capable of operating in either a single-priced vending configuration or in a multi-priced vending configuration and including means for effecting a ready conversion from the single- to the multi-priced configuration. In particular, the composite circuit includes a plurality of vend motors, each for effecting a vend cycle whereby upon energization, a single article is dispensed, a corresponding plurality of selector switches whereby one of the selector switches may be actuated to initiate a vend cycle and a corresponding plurality of selector relays for maintaing a vend motor energization circuit after the selector switch has been released. In the single-priced configuration, the selector switches and the selector relays are series-connected and a coin switch is actuated upon deposit of the correct amount of change, whereby each of the selector switches is primed to be actuated by the customer. In the multi-priced circuit configuration, one or more of the selector switches is disposed in a group to vend articles of a single price and are series-connected with each other and to their corresponding selector relay or relays. Thus, selector relays within a group corresponding to a single price are connected together and to their corresponding selector relays, whereas the selector switches and corresponding selector relays of another, second price are interconnected together, separate of the first-mentioned group.

The composite circuit of this invention provides a switching means whereby the composite circuit may be disposed from its single-priced configuration to its multi-priced configuration. In one illustrative embodiment of this invention, the switching means takes the form of a plug assembly comprising a plurality of mating plug elements, whereby selected plug elements are reconnected to effect the desired conversion. In particular, the switch means serves to reconnect in the multi-priced configuration the selector switches and selector relays into separate groups, each according to a separate price of the article to be vended. In addition, a multi-priced coin mechanism is incorporated into the multi-priced circuit configuration and is characterized as providing output signals indicative of the deposit of a corresponding amount of change, whereby the corresponding group of selector switches and selector relays is primed to be actuated. Thus, the coin mechanism responds to the deposit of a given value of coins whereby a corresponding group of selector relays and selector switches is primed to be actuated as by the output signal of the coin mechanism.

BRIEF DESCRIPTION OF THE DRAWINGS

These and other objects and advantages of the present invention will become more apparent by referring to the following detailed description and accompanying drawings, in which.

DESCRIPTION OF THE PREFERRED EMBODIMENT

Figure 1:
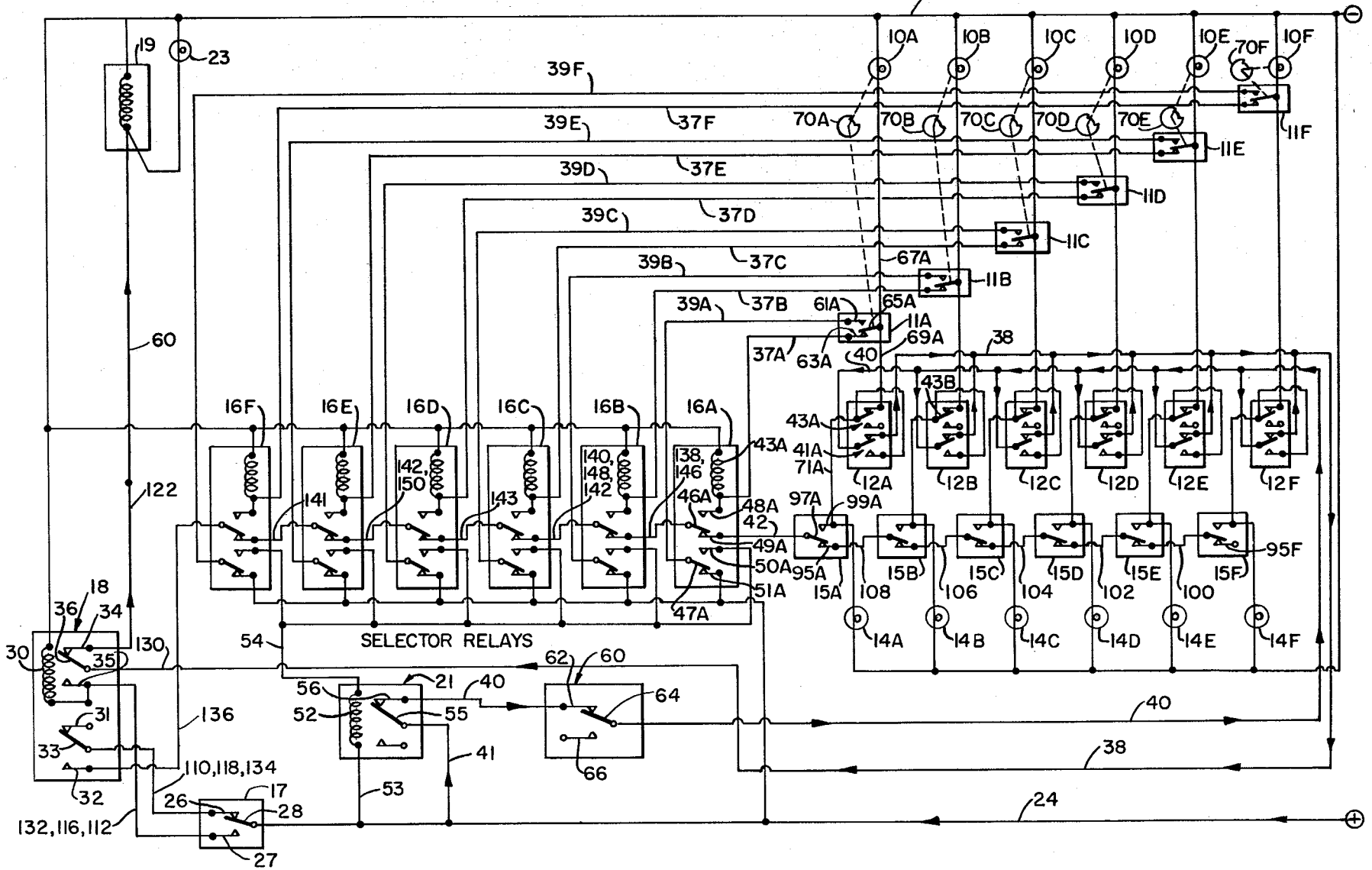
FIG. 1 is a schematic diagram of a part of the composite circuit of this invention, particularly illustrating the single-priced vending circuit configuration.
Figure 2:
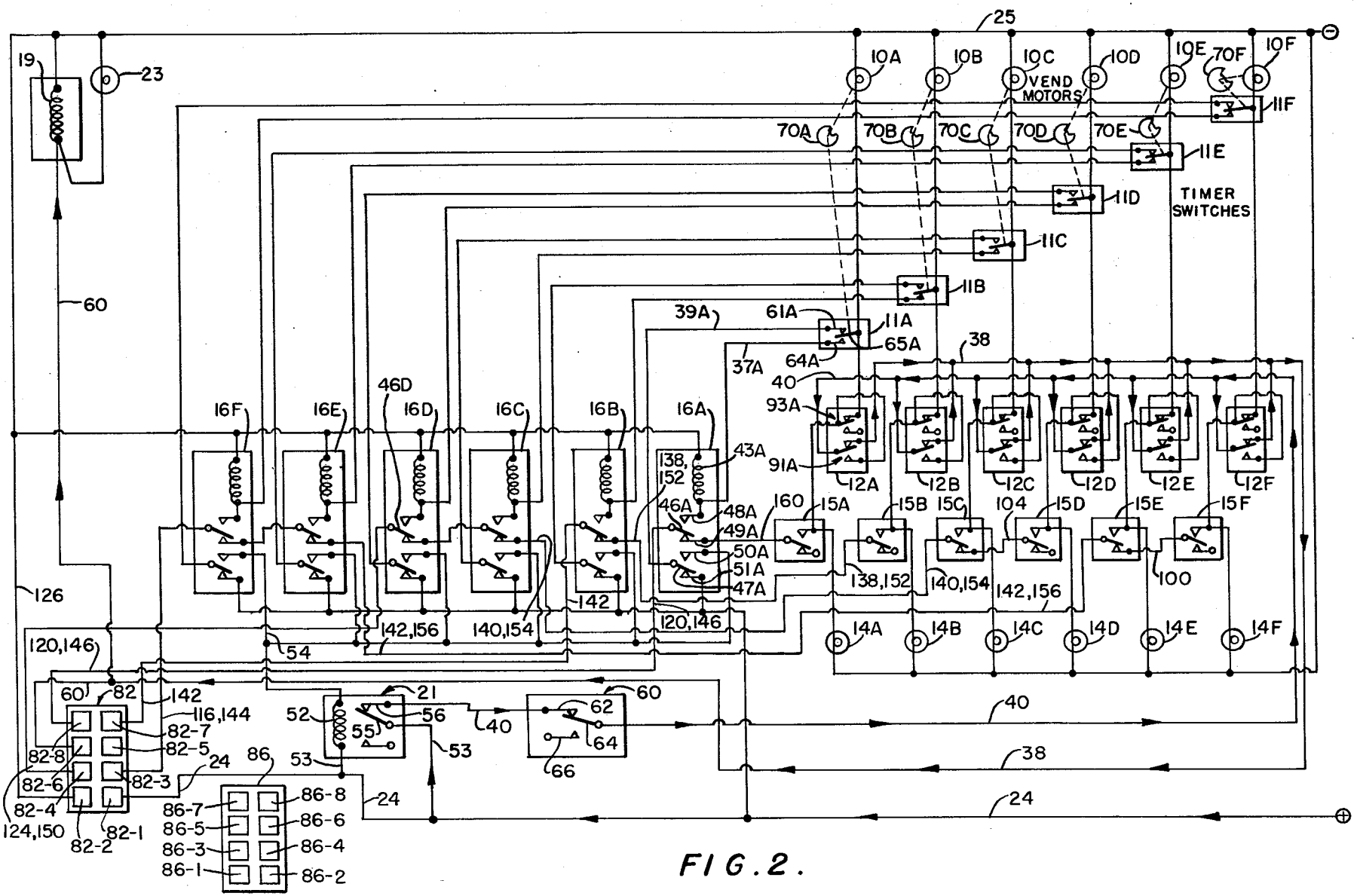
FIG. 2 is a schematic diagram of a part of the composite circuit of this invention, particularly illustrating the multi-priced vending circuit configuration.
Figure 3:
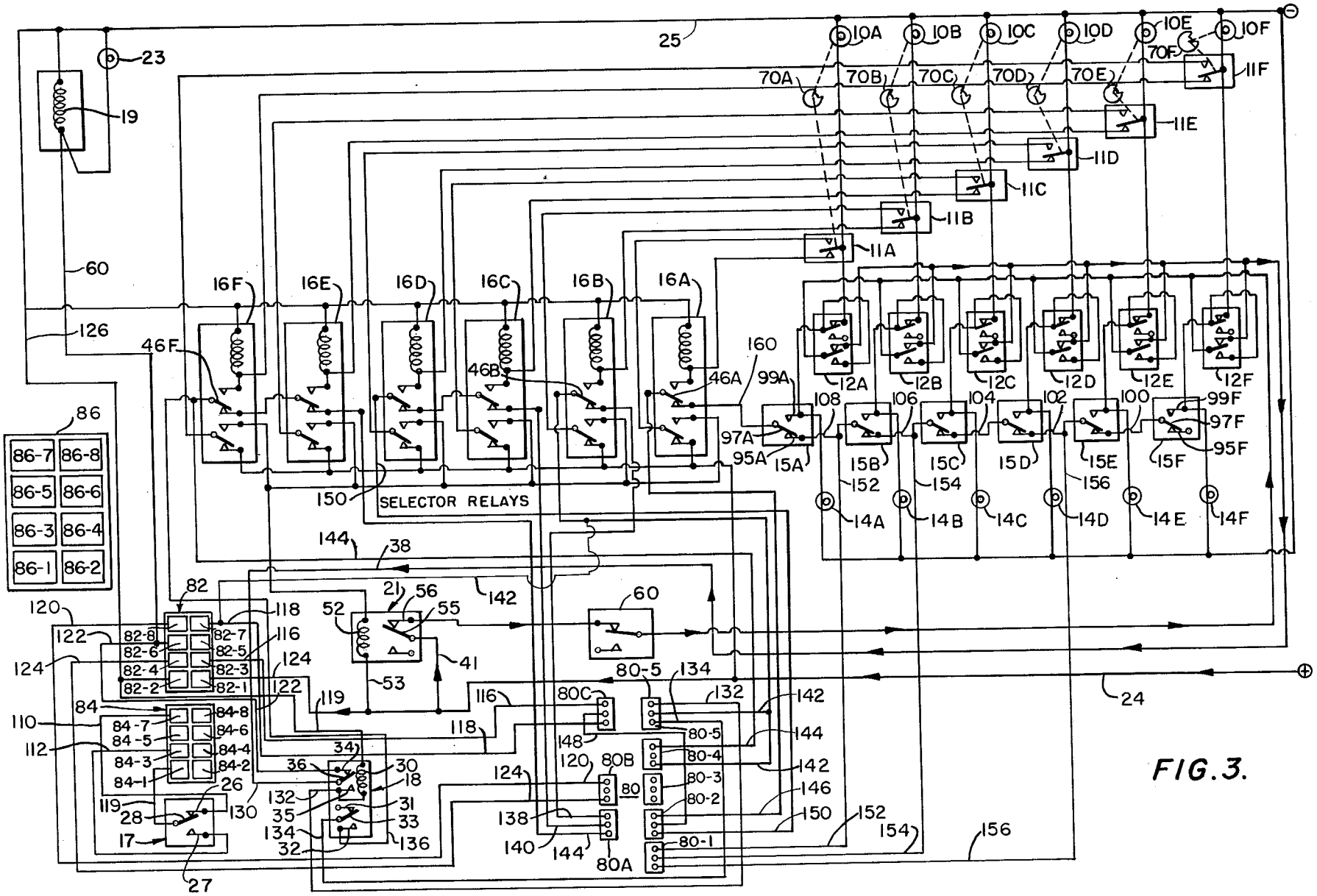
FIG. 3 is a schematic diagram of the composite circuit, illustrating both the single-priced and milti-priced circuit configuration and the manner in which conversion may be made from one configuration to the other.

For the sake of clarity, the circuit and operation of each of the single-priced vending configuration and the multi-priced vending configuration will first be explained with regard to FIGS. 1 and 2, respectively. FIGS. 1 and 2 respectively show the single-priced and multi-priced circuit configurations with the elements and connections of the other configuration deleted. FIG. 3 shows the composite circuit including all of the connectors required to connect the circuit elements in each of the single- and multi-priced circuit configurations as well as the switch means in the form of a plurality of connector assemblies.

The circuitry and the operation of the single-priced vending circuit configuration will be explained first with respect to FIG. 1. Realizing that many of the circuit elements in the multi-priced circuit configuration are identical with those in the single-priced configuration, the differences in circuitry of the multi-priced configuration as well as its operation will then be discussed. Finally, the composite circuit including all of the connectors and elements of each circuit configuration will be briefly discussed with respect to FIG. 3, emphasizing particularly the manner in which the single-priced vending circuit configuration may be converted to the multi-priced vending circuit configuration. The elements in each of the circuits of FIGS. 1, 2 and 3 are identified with corresponding numerals, though they may be connected in different configurations.

Referring now to the drawings and in particular to FIG. 1, there is illustrated the single-priced circuit configuration to be incorporated into the composite circuit of the present invention, for a coin-operated vending machine which includes a plurality of stacks or columns of articles to be dispensed, one-at-a-time, according to the choice of a customer. Illustratively, the composite circuit of this invention is illustrated as having six columns or stacks A to F of articles to be vended; however, it will be apparent that more or less than six columns may be utilized and the operating sequence for dispensing an article from each column is the same. The illustrated components in the vending control circuit of one column correspond to a like component in the control circuit of another column and are therefore designated with a like numerical reference character, which is followed by an alphabetical character designation corresponding to the particular column with which the component is associated.

Referring now first to FIG. 1, each column has associated therewith a vend motor 10, a timer switch 11, a composite sold-out switch 12, a sold-out indicator light 14, an operator-actuated selector switch 15 and a selector relay 16. Those components designated with the numerical character followed by the letter "A" are disposed for operation with respect to column A to effect selection of an article therefrom according to the choice of a customer, i.e., the customer actuation of the selector switch 15A corresponding to the selected article. In addition to components associated with a particular column, a number of common control components are provided including coin-operated vend switch 17, vend relay 18, coin-reject electromagnet 19 and credit-release 21.

Power to the circuits as illustrated in FIGS. 1, 2 and 3 is applied across a pair of supply conductors 24 and 25 which may be connected to a conventional source (not shown). The positive (+) terminal of line 24 designates the "hot line", while the negative (−) terminal connected to line 25 designates the ground return line.

Normally, credit is established by energization of the vend relay 18 upon insertion of a proper coin into a coin mechanism (not shown) whereby the vend switch 17 forming a part of the coin mechanism is actuated. The coin mechanism, including vend switch 17, may be a conventional coin-operated device adapted to receive coins of greater value than the cost of an article to be vended and dispense change accordingly, while momentarily being closed when the proper amount of coins is received and then returning the contacts to their original, open position.

More specifically, vend switch 17 includes a pair of fixed contacts 26 and 27 and a movable contact arm 28 to be disposed momentarily from the first position, as illustrated in FIG. 1, to a second position, when the proper amount of coins had been received. Movable contact arm 28 is connected to the supply conductor 24 and, upon displacement of the arm 28 from its first to its second position, establishes an energizing circuit to vend relay 18 through closed contacts 27, 28 and a conductor identified with the plural numerals 132, 116 and 112. As will be explained in detail later with respect to FIG. 3, circuit interconnections in the composite circuit may require plural conductors to make connection by way of one or more of the plurality of connector assemblies for converting the single-priced vending circuit configuration illustrated in FIG. 1 into the multi-priced vending circuit configuration of FIG. 2. The plural conductors 132, 116 and 112, which are shown and discussed in detail with respect to FIG. 3, are represented in FIG. 1 as a single connector, for the sake of brevity and clarity. The conductor 132, 116 and 112 is connected to one end of the energizing coil 30, whereas the other end of the energizing coil 30 is connected to supply conductor 25. Conductor 25 forms a common return or ground line for each of the vend motors 10A–10F, sold-out indicator lights 14A–14E and reject electromagnet 19.

Coin-reject electromagnet 19 provides a conventional coin-blocking function or operaton of its armature (not shown). In its normally-energized condition, the armature is actuated so as to permit a coin to be inserted for establishing credit; however, once the coin-operated vend switch 17 is closed and vend relay 18 is energized, the coin-reject electromagnet is de-energized to prevent the insertion of another coin.

In the single-priced circuit configuration as illustrated in FIG. 1, credit is established upon energization of coil 30 of vend relay 18, having a first set of contacts including fixed contacts 31, 32 and an associated movable contact arm 33, and a second set of contacts including contacts 34, 35 and associated movable contact arm 36. Contact arm 33 is connected to power line 24 through a conductor indicated by the joint numerals 110, 118 and 134, and normally-closed contacts 26, 28 of coin-operated vend switch 17.

Vend relay 18, prior to insertion of the proper coinage in the machine, is de-energized and input power through contacts 26, 28 and the conductor designated by the numerals 110, 118 and 134, terminates at contact 31, which is dead-ended. When coin switch 17 is momentarily actuated, power is applied through the conductor indicated by the numerals 132, 116 and 112, and coil 30 is energized causing movable contact arms 33 and 36 to be disposed from their first position as illustrated in FIG. 1, to their second position, to apply a positive energizing voltage to the contacts 32 and 35, respectively. A holding circuit for coil 30 is established through fixed contact 35 and contact arm 36 which is returned to power line 24 through a conductor 38, one or more of the normally-closed contacts or sold-out switches 12A–12E, conductor 40, normally-closed contacts or credit-release relay 21, and conductor 41.

Switching of contact 33 to its second position establishes an enabling circuit for the selector relays 16A–16F. The enabling circuit is traced from supply conductor 24, closed contacts 26 and 28, conductor 110, 118 and 134, closed contact arm 33 and contact 32, conductor 136, the normally-closed, serially-connected contacts of selector relays 16A–16F, to a selectively actuated one of the selector switches 15A–15F. As shown in FIG. 1, the selector relays 16A–16F are serially interconnected by conductors indicated with the numerals 138, 146; 140, 148, 142; 143; 142, 150; and 141. Closure of a selector switch 15 completes the energizing circuit through the associated sold-out switch 12 and timer switch 11 to the windings of the associated one of the selector relays 16A–16F through a conductor 42.

Each of the selector relays 16A–16F includes an energizing coil 43, a first or upper set of contacts 48 and 49 and a second or lower set of contacts 50 and 51. Each set of contacts includes its own contact arms 46 and 47, for being disposed between their fixed contacts 48, 49 and 50, 51, respectively. As shown in FIG. 1, the contacts, energizing coil and contact arm of a selector relay 16 corresponding to a particular column of the vending control circuit, is designated with a like letter; for example, the elements of selector relay 16A associated with column A, are designated with the letter "A" as a suffix.

The second or lower set of contacts 50, 51 is connected to ground, energizing a winding 52 of the credit-release relay 21 through corresponding ones of the timer switches 11A–11F, and vending motors 10A–10F. To this end, winding 52 has one terminal returned through conductor 53 to the supply conductor 24 and a second terminal connected to each contact 50 of the selector relays 16A–16F through conductor 54.

Credit-release relay 21 includes a single set of contacts and a movable contact arm 55 disposable in its normal, unenergized state in the position shown in FIG. 1, whereby an initial energizing circuit for the coin-reject electromagnet 19 is established. In particular, the initial energizing circuit is established from the plus supply conductor 24 through conductor 41, closed movable contact arm 55 and contact 56, conductor 40, closed door switch 60, one or more of the normally-closed sold-out switches 12A–12F, conductor 38, closed movable contact arm 36 and contact 34, and conductors 122 and 60.

Each sold-out switch 12 includes a first or upper set of contacts 93 and a second or lower set of contacts 91. As described above, the energizing circuit for the coin-reject electromagnet 19 is established through the normally-closed contact of the lower set 91. As shown in FIG. 1, the lower or second set of contacts 91 of each of the sold-out switches 12A–12F is connected in parallel by conductors 38 and 40. Each sold-out switch 12 is disposed at a corresponding column for monitoring the supply of articles and is actuated in a conventional manner from a first position illustrated in FIG. 1 to a second position upon depletion of the supply of articles in that column. When actuated to its second position, the second or lower set of contacts 91 of the sold-out switches 12 establishes and energizing circuit for a corresponding sold-out indicator light 14. The energizing circuit for applying a positive potential to the contact 36 of the vend relay 30 is not broken unless all of the sold-out switches 12A–12F are open.

The sole-out switches 12 include the first or upper set of contacts that is inserted in the energizing circuit for a corresponding vend motor 10. Thus if the supply of articles within the column is exhausted, the actuation of a selector switch 15, normally establishing an energizing circuit to the corresponding vend motor 10, is ineffective in that the upper set of contacts 93 is open, thus preventing energization of the corresponding vend motor 10.

Each vend motor 10 has associated therewith a corresponding timer switch 11 comprising a movable contact arm 65 and a pair of fixed contacts 61 and 63. The contact arm 65 of each timer switch 11 is adapted to be thrown from a first position, illustrated in FIG. 1, to a second position by a corresponding cam 70 rotatively coupled to its vend motor 10. Initial energization of the windings of the vend motor 10 is effected through conductors 67, 69 the normally-closed contacts of the upper set 93 of sold-out switch 12, conductor 71, and actuated selector switch 15.

The second position of each timer switch 11 after energization of its corresponding vend motor 10, establishes a bypass energizing circuit for that vend motor 10 through a corresponding conductor 39 and selector relay 16. Each timer switch 11 may be a microswitch having its movable contact arm 65 normally biased to the first position and adapted to be disposed to its second position by the corresponding timer cam 70. Upon energization of the selected vend motor 10, the corresponding timer cam 70 is rotated or driven whereby it disposes the movable contact arm 65 of the corresponding timer switch 11 to its second position, whereupon contact 63 and arm 65 are closed.

Each selector switch 15 has a movable contact 97 and a pair of fixed contacts 99 and 95. The movable contact 97 and the fixed contact 95 of the selector switches 15 are serially connected to each other by conductors 108, 106, 104, 102 and 100. The fixed contact 95F of the selector switch 15F is dead-ended, while the movable contact 97A is connected by the conductor 42 to the fixed contact 49A of the selector relay 16A.

Further, the door switch 60 includes a movable contact arm 64 and a pair of fixed contacts 62 and 66. Typically, the door switch 60 may take the form of a microswitch responsive to the closed position of the door of the vending apparatus to dispose the movable contact 64 to its first position as shown in FIG. 1. If the vending apparatus door is open, the movable contact 64 is disposed to its second position in contact with the fixed contact 66. Thus, with the door of the vending apparatus closed, an energizing circuit is formed from the positive supply conductor 24 through conductor 41, closed contacts 55 and 56, conductor 40, the closed contacts 62 and 64 of the door switch 60, conductor 40, one or more of the sold-out switch 12, conductor 38 to the movable contact 36 of the vend relay 18.

Initially, before a coin is inserted into the coin mechanism, the various aforedescribed switches of the single-priced circuit configuration are disposed as shown in FIG. 1 whereby an energization circuit is established to the coin-reject electromagnet 19 as explained above. Upon insertion of the proper value of coins, the coin-operated vend switch 17 is actuated whereby the contact arm 28 is disposed to its second position and a positive voltage is applied from conductor 24 through closed contacts 27 and 28, the conductor identified by the numerals 132, 116 and 112, contact 35 to energize the coil 30 of the vend relay 18, whereby the movable contacts 33 and 36 are disposed to their second position. As a result, a holding circuit for the energizing winding 30 is established from the negative supply conductor 25 through th coil 30, the closed contacts 35 and 36, conductor 38, one or more of the sold-out switches 12A–12F, conductor 40, normally-closed contacts 55 and 56 of the credit-release relay 21, conductor 41 to the positive supply conductor 24. After an initial disposition to its second position in response to coin deposit, the movable contact 28 of the coin switch 17 returns to its initial position. At this time, an enabling or energizing circuit is established from the positive supply conductor 24 through the closed contacts 26 and 28 of the coin switch 17, the closed contacts 32 and 33 of the vend relay, and conductor 136 to each of the serially-connected movable contacts 46 of the selector relays 16A–16F. Energization of the vend relay 18 also breaks the energizing circuit, previously described, for the coin-reject electromagnet 19 initially maintained through contacts 34 and 36.

The dispensing machine is now ready for a particular selection to be made by a customer, which selection is effected by actuating one of the selector switches 15A–15F. For example, assuming that selector switch 15A corresponding to column A is actuated by a customer, an energization circuit is established for vend motor 10A and selector relay 16A. In particular, the positive voltage derived from the supply conductor 24 is applied by a circuit formed of closed contacts 26 and 28 of coin switch 17, the conductor noted by the numerals 110, 118, 134, closed contacts 32 and 33, conductor 136, the serially-connected contacts 46 of selector relays 16A–16F, conductor 42, the closed contacts 97A and 99A of the actuated selector switch 15A, conductor 71A, the normally-closed contacts of the upper set 93A of sold-out switch 12A, and conductor 69A to apply a positive potential to contact 65A of timer switch 11A and to apply a positive potential by conductor 67A to energize initially the vend motor 10A.

Further, upon closure of the chosen selector switch, e.g. selector switch 15A, the corresponding selector relay 16A is likewise energized. In particular, the positive potential applied to the movable contact 64A of the timer switch 11A, as explained above, is applied by the conductor 37A to energize the energizing coil 43A of the corresponding selector relay 16A. It is understood that a positive potential is applied to the lowermost terminal of the energizing coil 43A, whereas the uppermost terminal thereof is coupled to the negative or ground supply conductor 25. Upon energization of the coil 43A, its contact arm 46A is disposed from its first position, as shown in FIG. 1, to its second position whereby contacts 46A and 48A are closed to establish a holding circuit for the selector relay 16A. In particular, the positive potential as applied to the series-connected contacts 46 of the selector relays is now applied across the energizing coil 43A in the example where the corresponding selector switch 15A was actuated. Further, upon energizing the energizing coil 43A of the selector relay 16A, the movable contact 47A is disposed from its first position as shown in FIG. 1 to its second position, whereby contacts 47A and 50A are closed.

The vend motor 10A which has been previously energized, rotates its coupled cam 70A, whereby the corresponding timer switch 11A is thrown from its first position as shown in FIG. 1 to its second position whereby contacts 65A and 61A are closed to establish an energizing circuit to the operating coil 52 of the credit-release relay 21. In particular, a circuit is established from the supply conductor 25 through conductor 67A, closed contacts 65A and 61A, conductor 39A, closed contacts 47A and 50A, and conductor 54 to the operating coil 52.

Upon actuation of the timer switch 11A to its second position by the vend-motor-driven cam 70A, the vend motor 10A which was initially energized through the selector switch 15A and then by a circuit formed through conductor 37A, is energized through a circuit comprised of conductor 67A, closed contacts 61A and 65A, conductor 39A, closed contacts 47A and 50A, conductor 54, the operating coil 52 of the credit-release relay 21, and conductor 53. Further, upon actuation of the timer switch 11A, the operating coil 52 of the credit-release relay 21 is energized to cause its contact arm 55 to move its fixed contact 56 and thus remove power from the operating coil 30 of the vend relay 18. In particular, the vend relay energizing circuit established through conductor 41, closed contacts 55 and 56, conductor 40, various of the sold-out switches 12, conductor 38, and closed contacts 35 and 36, is interrupted by the opening of normally-closed contacts 55 and 56.

Upon de-energization of the operating coil 30 of the vend relay 18, the vend relay contact arms 33 and 36 return to their normally-closed positions, as shown in FIG. 1. Thus, the holding circuit for the selector relay 16A established through the closed contacts 28 and 26 of the coin switch 17, the conductor indicated by the numerals 110, 118 and 134, closed contacts 32 and 33, conductor 136, the serially-connected selector relays 16, closed contacts 46A and 48A, is broken whereby the energizing potential applied to operating coil 43A is removed, thus de-energizing the selector relay 16A. As a result, the contact arms 46A and 47A of the selector relay 16A return to their normally-closed position, as shown in FIG. 1, again completing the energizing circuit to the vend motor 10A through now-closed contacts 51A and 47A, conductor 39A, closed contacts 61A and 65A, and conductor 67A. Further, the opening of contacts 47A and 50A removes an energizing potential from the winding 52 of the credit-release relay 21. The vend motor 10A continues to rotate its cam 70A unitl it has been driven through a complete cycle, at which time the contact arm 65A of the timer switch 11A is returned to its normally-closed position, as shown in FIG. 1, thereby removing an energizing potential from the vend motor 10A and completing its vend cycle. Thus, there has been described a complete vending cycle for the single-priced vending circuit configuration shown in FIG. 1. The circuit described above with respect to FIG. 1 is similar in structure and operation to that described in above-noted U.S. Pat. No. 3,486,601.

Referring now to FIG. 2, there is shown the multi-priced vending circuit configuration, whereby a plurality of articles may be vended at different prices. For example, in the illustrative circuit configuration as shown in FIG. 2, provision is made for vending four different kinds of articles at four different prices. The circuit elements and conductors of FIG. 2 are similar to that of FIG. 1 and the same elements and conductors previously described with respect to FIG. 1 are identified with the same numerals, and a description of them and their function will not be repeated. In order to permit vending of articles at different prices, the circuit elements are connected in a different configuration, as will be explained. With regard to FIG. 2, the selector switches 15E and 15F are adapted upon actuation to vend the lowest-priced articles, selector switch 15A to vend articles of the second-lowest price, selector switch 15B to vend articles of the second-highest or third lowest-priced, and selector switches 15C and 15D are adapted to vend articles of the highest price. Thus, in the multi-priced circuit configuration, selector switches 15E and 15F form a single group and are connected by a conductor designated by the numerals 142 and 156 to their corresponding selector relays 16F and 16E. Similarly, the selector switches 15C and 15D for vending articles of the highest price form a distinct group and are separately connected by a conductor designated by the numerals 140 and 154 to their corresponding group of selector relays 16D and 16C. In similar fashion, selector relay 15B for vending articles of the second-highest price forms, by itself, a distinct group and is connected to its selector relay 16B by a conductor identified by the numeral 138 and 152, whereas selector relay 15A, for vending articles of the second-lowest price, forms a distinct group and is connected to its selector relay 16A by conductor 160.

As a comparison of FIGS. 1 and 2 indicates, the coin switch 17 and the vend relay 18 of the single-priced vending configuration as shown in FIG. 1, are replaced by a multi-priced coin mechanism shown in FIG. 2 as a plug assembly 86 adapted to be mated with a corresponding plug assembly 82 interconnected to the multi-priced vending circuit configuration as shown. In an illustrative embodiment of this invention, the coin mechanism may take the form of a coin changer as manufactured by Coin Acceptors, Inc. under their designation numbers F75-9800 or F150-9400. Thus, the plug assembly 86 represents a terminal plug for such a coin receiving mechanism whereby appropriate control signals indicative of the receipt and totalization of an appropriate coin value are applied to the multi-priced circuit configuration. As indicated in FIG. 2, the plug assemblies 82 and 86 are adapted to be mated with each other and apply the positive and negative potentials as derived from supply conductors 24 and 25 to the terminals marked 82-1 and 82-2. In a manner similar to that described above with respect to FIG. 1, a vend or coin mechanism energizing circuit is formed through the normally-closed contacts 55 and 56 of the credit-release relay 21 to terminal 82-1 of the plug assembly 82 by a circuit comprised of conductor 53, closed contacts 55 and 56, conductor 40, various of the sold-out switches 12, and conductor 38. Further, upon deposit of coins in accordance with a first value or the lowest price of articles to be vended, a switching mechanism within the coin mechanism serves to interconnect the energizing potential applied to the terminal marked 82-1 to the terminal 82-3 whereby one of the selector relays 16E or 16F within the first group may be energized dependent upon which of the selector switches 15E or 15F is actuated by the customer. As seen in FIG. 2, the terminal 82-3 is connected by a conductor indicated by the numerals 116 and 144 to contact arm 46F of selector relay 16F. Upon deposit of further coin(s), the energizing voltage applied to terminal 82-1 is connected through the coin mechanism to terminal 82-8 whereby an energizing potential is applied by a conductor marked with numerals 120 and 146 to the contact arm 46A of the selector relay 16A forming the second group thereof. In a similar fashion, upon deposit of further coin(s) equaling or exceeding the second-highest value, the energizing potential applied to terminal 82-1 appears at terminal 82-7 to be applied by a conductor marked with numeral 142 to the contact arm 46B of the selector relay 16B forming the third group thereof. Finally, upon deposit of coin(s) equaling or exceeding the fourth or highest value or price, an energizing potential appears at terminal 82-4 to be applied by the conductor identifed with numerals 124 and 150 to the selector relays 16D and 16C of the fourth group; in particular, terminal 82-4 is connected to the contact arm 46D of the selector relay 16D.

Thus, each group of selector relays corresponding to a particular one of the four price levels is interconnected to a corresponding group of selector switch(es) whereby the selector switch 15 in that group may be actuated by the customer if coins of a value equal to or greater than the price of the articles corresponding to that group are deposited into the coin mechanism. However, if a selector switch 15 within a group corresponding to an article of higher price is actuated by the customer, the coin mechanism will not provide an energizing signal to the selector relay 16 within that group and thus a vending cycle will not be initiated. Thus, as seen in FIG. 2, the energizing circuit for each group of selector relays 16 through their corresponding selector switches 15 is distinct to the extent that a selector relay 16 of a higher coin level than that deposited within the coin mechanism may not be energized. For example, if a value of coin(s) corresponding to the lowest price is deposited within the coin mechanism, an energizing potential appears at the terminal 82-3 of the plug assembly 82, whereby either of the solenoids 16E or 16F may be actuated, dependent upon which of the corresponding selector switches 15E or 15F is actuated. For example, if selector switch 15F is closed, an energizing circuit from terminal 82-3 is established via the conductor identified by the numerals 116, 144, closed contacts 46F and 49F, closed contacts 46E and 49E, the conductor identified by the numerals 142 and 156, switch 15E, conductor 100, the selector switch 15F thrown to its uppermost position, the closed upper contacts 93F of the sold-out switch 12F, conductor 67F, the closed contacts 65F and 63F and conductor 37F to the coil 43F of the selector relays 16F. However, if a selector switch other than 15E or 15F is actuated, no energizing potential is applied to the separate energizing circuits of the groups, because a sufficient number of coins have not been deposited into the coin mechanism and no further energizing potential appears at any of the terminals 82-4, 82-7 or 82-8.

Though not described in the subject application, it is understood that the coin mechanism to be incorporated into the multi-priced circuit configuration, includes the capability of refunding the correct change if a selection is made of a price less than the coin value deposited into the coin mechanism.

The operation of the multi-priced circuit configuration is similar in many respects to that of the single-priced circuit configuration described above with respect to FIG. 1. Briefly, the multi-priced circuit configuration operates in the following manner. If coins according to the highest value of articles to be vended are deposited into the coin mechanism, energizing potential will be applied to each of the terminals 82-3, 82-7, 82-4, 82-8, whereby any of the selector relays may be potentially energized. Now if the selector switch 15D corresponding to one of the articles of highest price is actuated, a selector relay energizing circuit is established as described above, applying the potential derived at terminal 82-4 through an energizing circuit comprised of the conductor marked with the numerals 124 and 150, the closed contacts 46D and 49D, the closed contacts 46C and 49C, the conductor identified with the numerals 140 and 154, the closed lower contacts of selector switch 15C and the closed upper contacts of selector switch 15D, sold-out switch 12D, conductor 67D, the closed contacts 63D and 65D of the timer switch 11D, and conductor 37D to the coil 43D of the selector switch 16D. Upon energization of the coil 43D, the contact arms 46D and 47D are thrown to their uppermost position, whereby a hold circuit is established for the selector relay 16D through a circuit comprised of the conductor identified by the numerals 124 and 150, and closed contacts 46D and 48D. Further, upon the actuation of the selector switch 15D, an energizing circuit is established by the selector switch 15D to the vend motor 10D, thereby initiating the rotation of the vend motor 10D and its corresponding cam 70D through a vend cycle. As the vend motor rotates through its cycle the cam 70D, after a preselected interval, actuates the timer switch 11D, whereby contact arm 65D is disposed to its second position wherein contacts 61D and 65D are closed to establish an energizing circuit for the operating coil 52 of the credit-release relay 21; the credit-release relay energizing circuit comprises conductor 67D, closed contacts 61D and 65D, conductor 39D, closed contacts 47D and 50D of the selector relay 16D, and conductor 54 to energize coil 52. Upon energization of the credit-release relay 21, normally-closed contacts 55 and 56 are opened, thereby interrupting the coin mechanism energizing circuit to terminal 82-6 of the coin mechanism plug 82. As a result, the energizing potential applied to the operating coil 43D of the selector relay 16D is removed and the selector relay contact arms 47D and 49D returned to their original positions, interrupting the energizing potential to the credit-release relay energizing coil 52 as shown in FIG. 2. At this time, an energizing circuit is maintained to the vend motor 10D through conductor 67D, closed contacts 65D and 61D, conductor 39D and closed contacts 47D and 51D, to the supply conductor 24. The energized vend motor 10D continues to rotate until its cam 70D releases the timer switch 11D permitting the contact arm 65D to return to its normal, closed position, thereby interrupting the vend motor energizing circuit and completing a vend cycle.

Referring now to FIG. 3, there is shown the composite single-priced/multi-priced vending circuit in accordance with teachings of this invention having a capability of being readily adapted to operate in either the single-priced vending configuration as illustrated in FIG. 1 or in the multi-priced configuration as illustrated in FIG. 2. The composite circuit of FIG. 3 may be readily adapted through the use of switching means taking the form of plug assemblies 80, 82, 84 and 86, whereby the circuit interconnections between the substantially common circuit elements of the circuit configuration are reconnected into the desired circuit configuration.

With respect to FIG. 3, the single-priced circuit configuration is established by interconnecting the plug assembly 80 in the following manner. Connector elements 80-C is connected to connector element 80-5, connector element 80-B to connector element 80-3 and connector element 80-A to connector element 80-2. Further, the connector plug 84 associated with the coin switch 17 utilized in the single-priced circuit configuration, is plugged into the plug assembly 82. Further, the conductors 100, 102, 104, 106 and 108 are incorporated into the circuit as shown in FIG. 3, whereby the selector switches 15A-15F are connected in series. Thus, with the plug assemblies 80, 84 and 82 connected as described above, the circuit is disposed in the single-priced configuration, whereby the selector relays 16A-16F are connected in series with each other. In particular, the contact arm 46 of a first selector relay 16 is connected to the fixed contact 49 of the prior selector relay 16. For example, contact arm 46A of the selector relay 16A is connected directly to the contact 49B of selector relay 16B via conductor 146, plug element 80-2, plug element 80-A and conductor 138. In a similar manner, contact arm 46B of selector relay 16B is coupled to fixed contact 49C via conductor 142, connector element 80-5, connector element 80-C, conductor 148, connector element 80-2, connector element 80-A and conductor 140.

To assist in the ready understanding of the multi-and single-priced circuit configurations, the circuits shown in FIGS. 1 and 2 exclude the various switch means for converting the multi-priced circuit of FIG. 3 from its single-priced to its multi-priced circuit configuration. The composite circuit of FIG. 3 shows all of the conductors required for interconnecting the selector relays 16, in particular, and the other elements in each of the single-priced and multi-priced modes through the connector assemblies 80, 84, 82 and 86. Further, in each of FIGS. 1 and 2, the circuit interconnections between the elements have been simplified, eliminating the plural conductors and the showing of the connector assemblies that may be necessary to connect the composite circuit in either of its single-priced or multi-priced circuit configurations. To assist in relating the circuit configurations of FIGS. 1 and 2 to that of FIG. 3, the plural numerals of these conductors of the composite circuit of FIG. 3 are identified in each of FIGS. 1 and 2. For example, the direct connection between contact arm 46A and fixed contact 49B is illustrated in FIG. 1 as a single conductor, but is labeled with the numerals 138, 146 corresponding to the plural conductors required in the multiple circuit configuration of FIG. 3 to make such a connection through the connector plug 80. In a similar fashion, the groups of selector relays are interconnected by multiple conductors through the connector assembly 80.

Further, the vend relay 18 incorporated into the single-priced circuit configuration as shown in FIG. 1, is not used in the multi-priced circuit configuration of FIG. 2. Thus, when the composite circuit is disposed in the single-priced configuration of FIG. 1, the vend relay 18 is interconnected with the selector relays 16A to 16D, the coin switch 17 and the remaining elements and conductors of the single-priced circuit configuration. For example, the direct connection between contact 26 of the coin switch 17 and the contact arm 33 as shown in FIG. 1, is made by conductor 134, connector 80-5, connector 80-C, conductor 118, contact 82-7, contact 84-7 and conductor 110. In FIG. 1, the single-priced circuit configuration is identified with the numerals 110, 118 and 134.

Further, the selector switches 15 are serially connected in the single-priced circuit configuration as illustrated in FIGS. 1 and 3 by the conductors 100, 102, 104, 106 and 108. In particular, contact arm 97B is connected by conductor 108 to the fixed contact 95A of the selector switch 15A. Thus, there has been described above the manner in which the single-priced circuit configuration is formed within the composite circuit, as shown in FIG. 3.

In order to convert the composite circuit as shown in FIG. 3 from its single-priced to its multi-priced circuit configuration, the following steps are taken. First, the connector assembly 80 is reoriented in the following manner: connector 80-C is connected to connector 80-4, connector 80-B to connector 80-2, and connector 80-A to co-nector 80-1. Further, the connector assembly 84 used to contact the coin switch 17 to the composite circuit in the single-priced circuit configuration is removed and the assembly 86 associated with the multi-priced coin mechanism as described above with respect to FIG. 2, is interconnected to the connector assembly 82. Further, the conductors 102, 106 and 108 serially interconnecting the selector switches 15A-15F in the single-priced circuit configuration are transferred. In particular, conductor 102 is disconnected from contact 95D and reconnected to contact 95F; conductor 106 is transferred from contact 95B to contact 95D; and conductor 108 is transferred from contact 95A to contact 95B. As shown in FIG. 2, the conductors 104 and 110 serve to interconnect the selector switches 15C and 15D, and selector switches 15E and 15F into groups of selector switches. By transferring the above-named conductors and reorienting the connector assembly 80 in the manner described above, groups of selector switches 15 according to the price values are interconnected with each other into groups and with the corresponding selector relays 16 in a manner as shown and explained above with respect to FIG. 2. For example, as shown in FIG. 2, the selector relays 16F and 16E are connected in-series with each other and by a conductor identified with the numerals 142 and 156 to the contact arm 97E of selector switch 15E. Referring now to FIG. 3, the selector relays 16E and 16F of the lowest-priced group are connected by conductor 144, connector 80-A, connector 80-1 and conductor 156 to the contact arm 97E of selector switch 15E. In similar fashion, the selector relays 16D and 16C of the highest-priced group are connected by conductor 140, connector 80-A, connector 80-1 and conductor 154 to the contact arm of selector switch 15C. Further, the switch contact 46 of at least one selector relay 16 of each group is connected to the appropriate terminals of the connector assembly 82 in the following fashion. In particular, contact arm 46F of selector relay 16F is coupled to pin 82-3 via conductor 144, connector 80-4, connector 80-C and conductor 116. In similar fashion, contact arm 46D is coupled to the terminal 82-6 of the plug assembly 82 via conductor 150, connector 80-2, conductor 80-B and conductor 124. The terminals 82-7 and 82-8 are respectively connected to contact arms 46B and 46A in a similar fashion, as indicated by the numerals attached to the indicated conductors as shown in FIG. 2. In addition, the circuit path indicated by conductors 108, 106 and 102, as shown in FIG. 3, are interrupted so as to isolate from one another the selector switches corresponding to the illustratively-selected four groups. In an illustrative embodiment, the conductors 102, 106 and 108 may be provided with readily removable terminal connectors, whereby these conductors may be readily disconnected from at least one of the two interconnected selector switches. For example, one end of the conductor 108 may be removed from the switch arm of selector switch 15A.

Thus, there has been described a composite circuit including all of the conductor and circuit elements necessary for operation in a single-priced or multi-priced vending mode of operation. In particular, switching means in the illustrative form of plug or connector assemblies are utilized to permit, by relatively untrained servicemen, on-site rapid conversion of the composite circuit from its single-priced circuit configuration to its multi-priced circuit configuration. Further, though reference has been made to a particular type of multi-priced coin mechanism, it is realized that other such mechanisms may be incorporated into the multi-priced circuit configuration as described above with respect to FIGS. 2 and 3. For example, the multi-priced coin mechanism as described in the above referenced U.S. Pat. No. 3,776,339 also may be incorporated into the composite circuit of this invention.

During the course of the foregoing description, reference has been made to such terms as "upper set", "lower set", "front", "back", "top", "bottom", "up", "down", etc. It should be apparent that these are relative terms and are used to aid in the description of the component parts as used in the accompanying drawings and are not intended to limit the physical structure of the referenced component.

Numerous changes may be made in the above-described apparatus and the different embodiments of the invention may be made without departing from the spirit thereof; therefore, it is intended that all matter contained in the foregoing description and in the accompanying drawings shall be interpreted as illustrative and not in a limiting sense.

What is claimed is:

1. A composite vending circuit disposable in either of a first, single-priced circuit configuration adapted to be coupled to a first, single-priced coin-operated vend mechanism for establishing a first energization circuit in response to coin deposit of at least a first value, and of a second, multi-priced circuit configuration adapted to be coupled to a second multi-priced coin-operated vend mechanism for establishing at least a second energization circuit in response to coin deposit of at least a second value and for establishing a third energization circuit in response to coin deposit of at least a third value differing from the second value, said composite vending circuit comprising:

a. a plurality of vend motors each corresponding to one of a plurality of columns of articles adapted to be selectively dispensed from its corresponding column, one-at-a-time, according to the choice of a customer;

b. a plurality of selector switches, one for each vend motor, adapted upon selective actuation by the customer to energize a corresponding vend motor for dispensing an article from a selected column;

c. a plurality of selector relays, one for each corresponding vend motor and selector switch, having an operating winding adapted to be selectively energized upon actuation of its corresponding selector switch; and d. switch means disposable to a first position for connecting said selector relays in series with each other and for connecting the first energization circuit of the single-priced coin-operated vend mechanism to said series-connected selector relays whereby said circuit is disposed in its single-priced circuit configuration, and to a second position for connecting independently the second and third energizing circuits, respectively, to first and second groups of corresponding selector relays and for connecting independently said first and second groups of selector relays to corresponding first and second groups of selector switches, whereby said composite circuit is disposed in its multi-priced circuit configuration.

2. The composite vending circuit as claimed in claimed 1, wherein each of said selector relays comprises a first set of first and second contacts and a contact arm disposable therebetween, said first contact connected to said operating winding of said selector relay, said switch means in its first position connecting said second contact of said first set of one selector relay to said contact arm of the next selector relay.

3. The composite vending circuit as claimed in claim 2, wherein each of said selector switches includes a set of first and second contacts and a contact arm disposed therebetween, further, including a plurality of conductors for interconnecting said second contact of said selector switches to the said contact arm of the next, successive selector switch, whereby said selector switches are connected in series in said single-priced circuit configuration, said conductors interconnecting selector switches in differing groups having terminals adapted to be removably coupled, whereby said aforementioned conductors may be disconnected in said multi-priced circuit configuration.

4. The composite vending circuit as claimed in claim 2, wherein each of said selector switches includes a set of first and second contacts and a contact arm disposable therebetween, said switch means in its second position connecting said second contact of said first set of one selector relay in each group to said contact arm of one of said selector switches within the corresponding selector switch group.

5. The composite vending circuit as claimed in claim 4, further comprising a cam-operated timer switch for each vend motor having first and second contacts and a contact arm arranged to be actuated by its associated motor between said first and second contacts, conductor means for connecting said second contact of said timer switch to said operating winding of its corresponding selector relay, said timer switch contact arm connected to said first contact of its corresponding selector switch, whereby when said timer switch contact arm of one of said selector switches is disposed in contact with its second contact, an initial energizing circuit is formed through said corresponding timer switch to said operating coil of said corresponding selector relay, thus disposing said selector relay contact arm of said first set in contact with its second contact.

6. The composite vending circuit as claimed in claim 5, wherein each of said selector relays comprises a second set of first and second contacts and a contact arm, and there is further included a credit-release relay comprising a set of first and second contacts, a contact arm disposable therebetween, and an energizable coil for disposing its contact arm from said first to its second contact, said credit-release relay operating coil connected in common to each of said first terminals of said second set of said selector relays.

7. The composite vending circuit as claimed in claim 6, wherein each of the first and second coin-operated vend mechanism comprises first and second terminals and is responsive to the deposit of coins for applying an energizing signal from its first to its second terminal, said switch means comprises a releasable plug assembly adapted to be coupled to the first and second terminals of each of said first and second vend mechanisms, means for forming either of the first or second energization circuits through said contact arm and first contact of said credit-release relay and said plug assembly to said first terminal of one of said coin-operated vend mechanisms.

8. The composite vending circuit as claimed in claim 7, wherein there is included a conductor for connecting the terminal adapted to be mated to the second terminal of each of the first and second vend mechanisms to said contact arm of said first set of one of said selector relays.

9. The composite vending circuit as claimed in claim 8, wherein said second vend mechanism includes a third terminal and is responsive to the coin deposit of the third value to establish the third energization circuit to its third terminal, said switch means in its second position connecting independently the terminal of its plug assembly adapted to engage the third terminal of said second vend mechanism to said contact arm of said first set of a selector relay of a group different from that of said one selector relay.

10. A composite vending circuit operable in either of a first, single-priced circuit configuration or in a second, multi-priced circuit configuration, said composite vending circuit comprising:

a. a plurality of vend motors, each of which corresponds to a separate column of a plurality of columns of articles and is arranged to be selectively energized to dispense articles from its corresponding column, one-at-a-time, according to the choice of a customer;

b. a plurality of selector switches, each corresponding to one of said plurality of motors and adapted upon selective actuation by a customer to energize a corresponding vend motor for dispensing of an article from the selected column;

c. a plurality of selector relays, each corresponding to one of said plurality of motors and to one of said plurality of selector relays, and having an operating coil adapted to be selectively energized upon actuation of its corresponding selector switch;

d. a first, single-priced vend switch assembly comprising first and second terminals and responsive to coin deposit of a first value for applying an energizing signal from its first to its second terminal;

e. a second, multi-priced coin-operated vend switch assembly comprising first, second and third terminals and responsive to coin deposit of at least a second value for applying an energizing signal from its first to its second terminal and responsive to coin deposit of at least a third value differing from the second value for applying the energizing signal from its first terminal to its third terminal; and f. switch means disposable to a first position corresponding to the first, single-priced circuit configuration for connecting said selector relays in series with each other and for connecting the second terminal of said first, single-priced vend switch assembly to said series-connected selector relays whereby upon actuation of one of said pluralities of selector switches, said operating coil of a corresponding selector relay is energized, and to a second position corresponding to the multi-priced circuit configuration for connecting independently the second and third terminals of said second, multi-priced vend switch assembly to first and second selector switch groups and for connecting independently said first and second selector switch groups to corresponding first and second selector relay groups, whereby upon coin deposit of the second value, only one selector relay of said first selector relay group is actuable in response to the actuation of one selector switch of the corresponding first selector switch group, and upon coin deposit of the third value, one of said selector relays of said first and second selector relay groups is energizable in response to the actuation of a corresponding selector switch of the first and second selector switch groups.

11. The composite circuit as claimed in claim 10, wherein said first, single-priced vend switch assembly comprises a coin switch comprising a set of first and second contacts and a switch arm disposable from its first to its second contact upon coin depsit of the first value, and a vend relay comprising a first set of first and second contacts and a first movable contact arm therebetween, a second set of first and second contacts and a contact arm movable therebetween, and an energizable coil for disposing said contact arms of said first and second sets from their first to their second contacts, said switch means in its first position interconnecting said second contact of said first set of said vend relay to said second contact of said single-priced vend switch whereby, upon coin deposit of the first value, an energizing signal is applied to said energizable coil of said vend relay, and said contact arm of said second set is connected to said first contact of said coin switch whereby the energizing signal is applied to the series-connected selector relays.

12. The method of converting a composite vending circuit from a single-priced circuit configuration to a multi-priced circuit configuration wherein the composite vending circuit includes a plurality of vend motors, each of which corresponds to a separate column of articles and is arranged to be selectively energized to dispense articles from a corresponding column, one-at-a-time, according to the choice of a customer; a plurality of selector switches, one for each motor, adapted upon selective actuation by a customer to energize a corresponding vend motor for dispensing an article from a selected column; a plurality of selector relays, one for each motor and selector switch, having an operating winding adapted to be selectively energized upon actuation of its corresponding selector switch; a first, single-priced coin-operated vend switch having a set of first and second terminals, and responsive to coin deposit of a first value for applying an energizing signal from its first to its second terminal; a second, multi-priced coin-operated vend switch including first, second and third terminals and responsive to coin deposit of at least a second value for applying an energizing signal from its first to its second terminal and responsive to coin deposit of a third value differing from the second value for applying an energizing signal from its first to its second and third terminals; and switch means disposable to a first position for disposing said composite circuit in its single-priced circuit configuration and to a second position for disposing said composite circuit to its multi-priced circuit configuration, said method comprising the steps of:

disposing the switch means from its first position wherein said selector relays are connected in series with each other and the second terminal of the single-priced, coin-operated vend switch is connected to said series-connected selector relays, to its second position wherein the second and third terminals of the multi-priced coin vend switch are connected independendtly to first and second groups of selector relays, respectively, and for connecting independently said first and second groups of selector relays to corresponding first and second groups of selector switches.

13. The converting method as claimed in claim 12, wherein there is further included the step of disconnecting the conductor connecting in the single-priced circuit configuration, a selector switch of the first group to a selector switch of the second group, whereby independent circuits are established for energizing the vend motors corresponding to the distinct first and second groups of selector switches according to the coin deposit into the multi-priced coin vend switch.

* * * * *

UNITED STATES PATENT AND TRADEMARK OFFICE

CERTIFICATE OF CORRECTION

PATENT NO. : 4,094,398

DATED : June 13, 1978

INVENTOR(S) : Vernon D. Camp and Raymond D. Bowman

It is certified that error appears in the above-identified patent and that said Letters Patent are hereby corrected as shown below:

Claim 1, column 16, line 8, after "said" insert --composite--.

Claim 3, Examiner's Amendment of December 30, 1977, page 2, paragraph 2, --further including-- has not been added to Claim 4.

Claim 6, column 16, line 68, after "energizable" insert --operating--.

Claim 7, column 17, line 7, "mechanism" should be plural.

Claim 12, column 19, line 14, correct spelling of "independently".

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*